US007710410B2

(12) United States Patent
Shimizu

(10) Patent No.: US 7,710,410 B2
(45) Date of Patent: May 4, 2010

(54) ELECTRO-OPTICAL DEVICE, METHOD OF DRIVING ELECTRO-OPTICAL DEVICE, AND ELECTRONIC APPARATUS

(75) Inventor: Koji Shimizu, Matsumoto (JP)

(73) Assignee: Epson Imaging Devices Corporation, Tokyo (JP)

( * ) Notice: Subject to any disclaimer, the term of this patent is extended or adjusted under 35 U.S.C. 154(b) by 790 days.

(21) Appl. No.: 11/432,559

(22) Filed: May 12, 2006

(65) Prior Publication Data

US 2007/0024564 A1 Feb. 1, 2007

(30) Foreign Application Priority Data

Jul. 26, 2005 (JP) ..... 2005-215459
Jan. 13, 2006 (JP) ..... 2006-005739

(51) Int. Cl.
*G09G 5/00* (2006.01)

(52) U.S. Cl. ..... 345/204; 345/87; 345/100

(58) Field of Classification Search ..... 345/200–214, 345/204, 100, 87
See application file for complete search history.

(56) References Cited

U.S. PATENT DOCUMENTS

2002/0126107 A1* 9/2002 Inoue et al. ..... 345/204
2002/0175887 A1* 11/2002 Yamazaki ..... 345/87
2004/0207458 A1* 10/2004 Origasa et al. ..... 327/535
2005/0083084 A1 4/2005 Atoa et al.
2006/0022920 A1* 2/2006 Lee ..... 345/87

FOREIGN PATENT DOCUMENTS

JP 2000-330085 11/2000
JP 2001-356746 12/2001
WO WO2004040544 5/2004

* cited by examiner

*Primary Examiner*—Amare Mengistu
*Assistant Examiner*—Insa Sadio
(74) *Attorney, Agent, or Firm*—Lowe Hauptman Ham & Berner, LLP

(57) ABSTRACT

An electro-optical device includes an entire screen display mode in which an entire screen is displayed and a partial display mode in which a part of an entire screen is set to a display region and the remaining part is set to a non-display region. A scanning line driving circuit supplies a first voltage to the scanning lines of the display region for a predetermined period in the entire screen display mode, and supplies a second voltage to the scanning lines of the display region for a period longer than the predetermined period in the partial display mode.

9 Claims, 8 Drawing Sheets

ELECTRO-OPTICAL DEVICE, METHOD OF DRIVING ELECTRO-OPTICAL DEVICE, AND ELECTRONIC APPARATUS

BACKGROUND

Related Applications

The present application is based on, and claims priority from, Japanese Application Serial Number 2005-215459, filed Jul. 26, 2005 and Japanese Application Serial Number 2006-5739, filed Jan. 13, 2006, the disclosures of which are hereby incorporated by references herein in its entirety.

1. Technical Field

The present invention relates to an electro-optical device that uses an electro-optical material, such as liquid crystal, to a method of driving an electro-optical device, and to an electronic apparatus having an electro-optical device.

2. Related Art

In general, electro-optical devices, such as liquid crystal display devices for displaying images or the like, have been known. This electro-optical device includes, for example, a liquid crystal panel, and a driving circuit that drives the liquid crystal panel. For example, the electro-optical device has the following structure.

The electro-optical device includes a liquid crystal panel, a liquid crystal driving circuit that drives the liquid crystal panel, a control circuit that controls the liquid crystal driving circuit, and a liquid crystal driving power supply circuit that supplies a driving voltage to the liquid crystal driving circuit. The liquid crystal driving circuit includes a scanning line driving circuit and a data line driving circuit.

The liquid crystal panel includes an element substrate, a counter substrate, and liquid crystal serving an electro-optical material. In the element substrate, thin film transistors (hereinafter, simply referred to as TFTs), which serve as switching elements (which will be described in detail below), are disposed in a matrix. The counter substrate is disposed so as to be opposite to the element substrate, and the liquid crystal is interposed between the element substrate and the counter substrate.

The element substrate includes a plurality of scanning lines that are provided at predetermined gaps, a plurality of data lines that are provided at predetermined gaps in a direction substantially orthogonal to the plurality of scanning lines, and capacitor lines that are disposed substantially parallel to the plurality of scanning lines and provided alternately with the plurality of scanning lines.

A plurality of pixels are provided at intersections between the plurality of data lines and the plurality of scanning lines. Each of the pixels includes a pixel electrode and a storage capacitor that has one end connected to the pixel electrode and the other end connected to the capacitor line, in addition to the above-mentioned TFT.

The TFT has a gate that is connected to the scanning line, a source that is connected to the data line, and a drain that is connected to the pixel electrode and the storage capacitor.

In the counter substrate, a plurality of common lines are provided so as to be substantially parallel to the plurality of scanning lines. In the counter substrate, a common electrode is formed so as to be opposite to the pixel electrodes. The common electrode is connected to the common line.

The electrode-optical device having the above-mentioned structure operates as follows. That is, a selection voltage is line-sequentially supplied, so that all of the pixels corresponding to a predetermined scanning line are selected. In addition, an image signal according to a gray-scale level of the pixel is supplied to the data line in synchronization with the selection of the pixel. Thereby, the image signal is supplied to all of the pixels selected with the selection voltage, so that the image data is written in the pixel electrode.

In the electro-optical device, in a state in which a voltage of the common electrode is used as a reference voltage, positive polarity writing, in which an image signal is supplied to the data line with a voltage greater than the voltage of the common electrode, and negative polarity writing, in which an image signal is supplied to the data line with a voltage smaller than the voltage of the common electrode, are alternately performed.

If the image signal is written in the pixel electrode of the pixel, a driving voltage is applied to the liquid crystal due to the potential difference between the pixel electrode and the common electrode. Accordingly, a voltage level of the image signal is changed, so that the alignment or order of the liquid crystal molecules is changed, which results in gray-scale display through optical modulation of each pixel.

In addition, the driving voltage that is applied to the liquid crystal is held by the storage capacitor for a longer time, namely, for a period as much as three orders of magnitude longer than the time for which the image signal is written.

In this case, in the electro-optical device having the above-mentioned structure, a parasitic capacitance is generated between the gate and the drain of the TFT. Also, a parasitic capacitance is generated between the source and the drain of the TFT. If the gate voltage of the TFT enters an off state, an electric charge accumulated in the storage capacitor and an electric charge accumulated in a pixel capacitor consisting of the pixel electrode and the common electrode are redistributed while including parasitic capacitances, which results in generating so-called pushdown that the voltage of the pixel electrode is reduced and the voltage applied to the liquid crystal is also reduced.

In both the positive polarity writing and the negative polarity writing, the pushdown is always generated. Therefore, a center voltage Vc, which is a center value between a positive polarity image signal and a negative polarity image signal, is set higher than the voltage VCOM of the common electrode by a pushdown voltage.

In the meantime, the electro-optical device having the above-mentioned structure is used in, for example, a portable apparatus. In recent years, the portable apparatus has been required to further reduce a consumed power. Accordingly, display is performed on an entire screen of a display screen (hereinafter, this case is referred to as an entire screen display mode), and display is performed on only a part of a display screen (hereinafter, this case is referred to as a partial display mode), which results in a decrease of a consumed power (for example, see JP-A-2001-356746).

In the electro-optical device disclosed in JP-A-2001-356746, in the partial display mode, a display screen is divided into a display region and a non-display region. On the display region, a remaining battery capacity or time is displayed, and nothing is displayed on the non-display region. That is, in a normally white mode, the non-display region is displayed with a white color, and in a normally black mode, the non-display region is displayed with a black color.

In the above-mentioned partial display mode, similar to the above-mentioned entire screen display mode, if a center voltage Vc of the image signal is set higher than a voltage VCOM of the common electrode by a pushdown voltage, even though nothing is displayed on the non-display region, the potential difference is always generated between the pixel electrode and the common electrode due to the pushdown voltage, which results in an increase of a consumed power.

Accordingly, in the partial display mode, in order to reduce the consumed power in the non-display region, the center voltage Vc of the image signal is set so as to be the same as the voltage VCOM of the common electrode. Thereby, the consumed power is reduced in the non-display region.

However, in the partial display mode, if the center voltage Vc of the image signal is the same as the voltage VCOM of the common electrode, even through the consumed power in the non-display region can be reduced, in the display region, the center voltage Vc of the image signal becomes smaller than the voltage VCOM of the common electrode by the pushdown voltage. Therefore, an image quality may be deteriorated on the display region due to flickering.

SUMMARY

An advantage of some aspects of the invention is that it provides an electro-optical device which is capable of reducing an image quality from being deteriorated when partial display is performed, a method of driving an electro-optical device, and an electronic apparatus.

According to a first aspect of the invention, an electro-optical device includes a plurality of scanning lines; a plurality of data lines; a plurality of pixels that are provided so as to correspond to intersections between the plurality of scanning lines and the plurality of data lines, each of the pixels has a pixel electrode, and a switching element that allows, when the selection voltage is applied to the scanning line, the data line and the pixel electrode to enter a conductive state; a scanning line driving circuit that supplies a selection voltage for selecting the plurality of scanning lines in a predetermined order; and a data line driving circuit that supplies, when the scanning line is selected, an image signal to the corresponding data line in accordance with a gray-scale level of the corresponding pixel. Further, an entire screen display mode in which an entire screen is displayed and a partial display mode in which a part of an entire screen is set to a display region and the other portion is set to a non-display region are selected, and the scanning line driving circuit supplies a first voltage to the scanning lines of the display region for a predetermined period in the entire screen display mode, and supplies a second voltage to the scanning lines of the display region for a period longer than the predetermined period.

According to this aspect, even though the display region in the partial display mode becomes narrower than the display region in the entire screen display mode, one frame period does not vary. Therefore, in the display region, the selection period per scanning line becomes longer than the selection period per scanning line in the entire screen display mode.

As a result, in the partial display mode, it is possible to relatively reduce the influence due to the variation of the period, for which the switching element is turned on, with respect to a period required for sufficiently writing the image data in the pixel electrode. Therefore, it is possible to ensure time needed for the image data to write in the pixel electrode, a color deviation of the displayed image can be reduced, and an image quality can be prevented from being deteriorated.

Preferably, the second voltage is smaller than the first voltage.

It has been determined that the pushdown voltage is proportional to the selection voltage supplied to the scanning line.

In the partial display mode, since the selection voltage smaller than the selection voltage in the entire screen display mode is supplied to the scanning lines, the pushdown voltage can be reduced. Accordingly, it is possible to reduce the image quality from being deteriorated due to flickering in the display region in the partial display mode.

In addition, in the partial display mode, since the image signal Vc becomes smaller than the voltage VCOM of the common electrode by the pushdown voltage, the image quality may be deteriorated due to flickering in the display region, and the burning may occur in the display region.

However, according to this aspect, since the pushdown voltage in the partial display mode can be reduced, it is possible to reduce the burning in the display region.

In addition, in the partial display mode, the selection voltage supplied to the scanning line can be reduced, as compared with the entire screen display mode. Therefore, in the partial display mode, the consumed power can be reduced.

In addition, in the partial display mode, the selection period per scanning line can be longer, as compared with the entire screen display mode. As a result, it is possible to reduce an operation clock when the selection voltage is supplied to the scanning line from the scanning line driving circuit. Accordingly, in the partial display region, the consumed power can be further reduced.

In the meantime, if the selection voltage supplied to the scanning line is reduced, an influence by the characteristic variation of the switching element can be increased, a variation occurs during a period when the switching element is turned on, and the image data supplied from the data line driving circuit is not sufficiently written in the pixel electrode. As a result, the color variation may occur in the display image.

However, in the partial display mode, the selection period per scanning line becomes longer, as compared with the entire screen display mode. Therefore, it is possible to obtain time needed for writing the image data in the pixel electrode, to reduce the color variation in the displayed image, and to reduce the image quality from being deteriorated.

Preferably, the electro-optical device further includes a power supply circuit that generates the first voltage and the second voltage. Further, preferably, the power supply circuit has a charge pump circuit that raises an input voltage to generate the first voltage and the second voltage.

According to this aspect, the electro-optical device includes the power supply circuit that has the charge pump circuit for generating the first voltage and the second voltage. Therefore, if the power supply circuit is one, since the scanning line driving circuit can supply the selection voltage of the first voltage and the second voltage to the scanning lines, a circuit size or consumed power can be reduced, as compared with a case in which two power supply circuits are required, that is, a case in which a power supply circuit for generating the first voltage and a power supply circuit for generating the second voltage are required.

Preferably, the charge pump circuit has a plurality of stages of voltage raising circuits that are connected in series to each other, the first voltage is generated by a final stage of a voltage raising circuit among the plurality of stages of voltage raising circuits, and the second voltage is generated by a middle stage of a voltage raising circuit among the plurality of stages of voltage raising circuits.

According to this aspect, the plurality of stages of voltage raising circuits are connected in series to the charge pump circuit, and the first voltage generated by the final stage of a voltage raising circuit among the plurality of stages of voltage raising circuits is supplied to the scanning line as the selection voltage in the entire screen display mode and the second voltage generated by the middle stage of voltage raising circuit among the plurality of stages of voltage raising circuits is supplied to the scanning line as the selection voltage in the partial surface display mode. As a result, in the partial display mode, it is not necessary that voltage raising circuits of stages later than the middle stage of voltage raising circuit among the plurality of stages of voltage raising circuits, which generates the second voltage, are driven. Therefore, in the partial display mode, the consumed power can be further reduced.

According to a second aspect, there is provided an electronic apparatus including the above-mentioned electro-optical device.

According to this aspect, the same effect as the above can be obtained.

According to a third aspect, there is provided a method of driving an electro-optical device, the electro-optical device including a plurality of scanning lines, a plurality of data lines, and a plurality of pixels that are provided so as to correspond to intersections between the plurality of scanning lines and the plurality of data lines, each of the pixels has a pixel electrode, and a switching element that allows, when the selection voltage is applied to the scanning line, the data line and the pixel electrode to enter a conductive state, an entire screen display mode in which an entire screen is displayed and a partial display mode in which a part of an entire screen is set to a display region and the other portion is set to a non-display region being selected. The method includes supplying a selection voltage for selecting the plurality of scanning lines in a predetermined order; supplying, when the scanning line is selected, an image signal to the corresponding data line in accordance with a gray-scale level of the corresponding pixel, and supplying a first voltage to the scanning line of the display region for a predetermined period in the entire screen display mode while supplying a second voltage to the scanning lines of the display region for a period longer than the predetermined period in the partial display mode.

According to this aspect, the same effect as the above can be obtained.

BRIEF DESCRIPTION OF THE DRAWINGS

The invention will be described with reference to the accompanying drawings, wherein like numbers reference like elements, and wherein.

DESCRIPTION OF EXEMPLARY EMBODIMENTS

Figure 1:
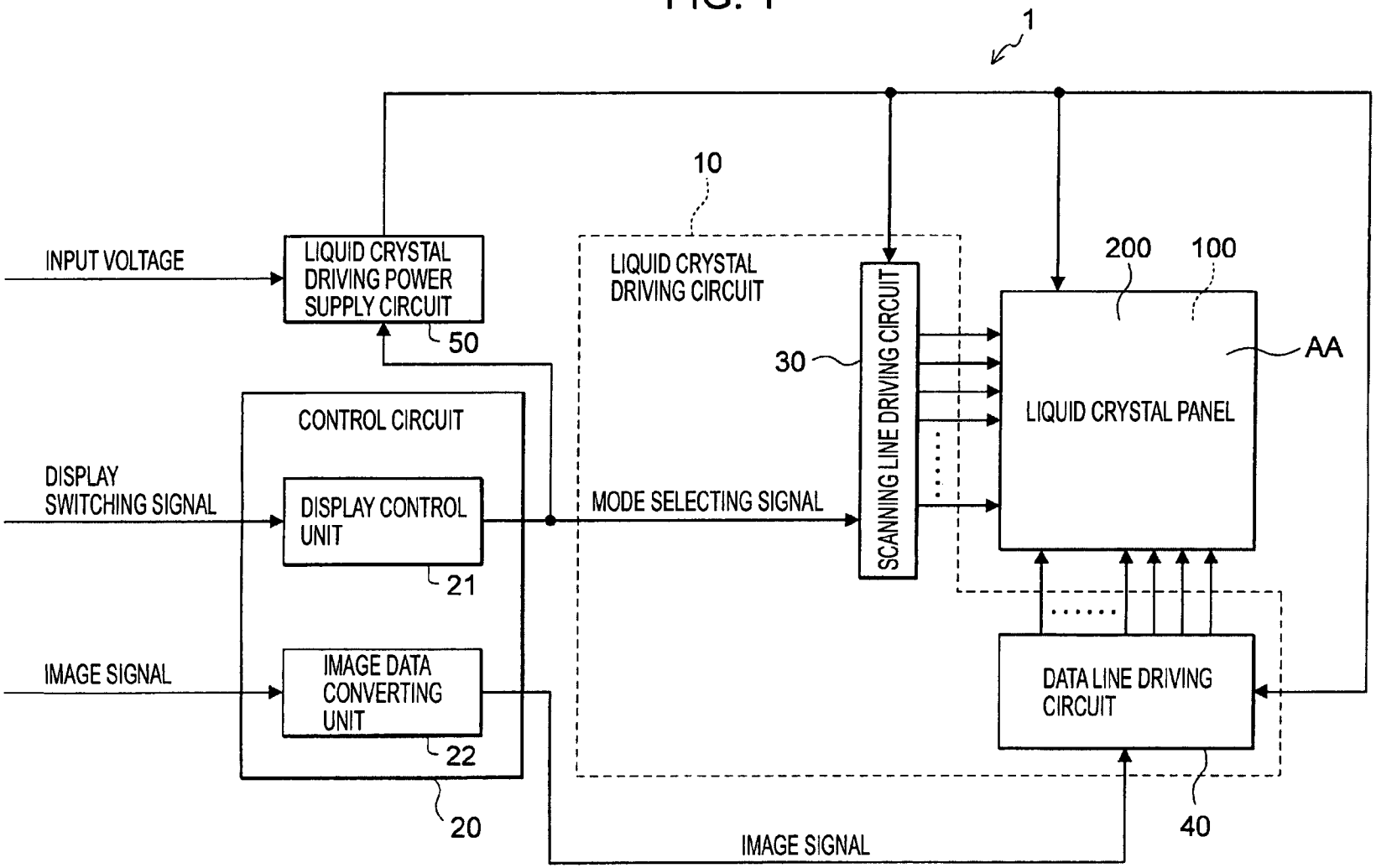
FIG. 1 is a block diagram illustrating a structure of an electro-optical device according to a first embodiment of the invention.

Hereinafter, preferred embodiments of the invention will be described in detail with reference to accompanying drawings. In the preferred embodiments and modifications, which will be described in detail below, the same constituent elements are denoted by the same reference numerals, and the description thereof will be omitted or simplified.

First Embodiment

FIG. 1 is a block diagram illustrating an electro-optical device 1 according to a first embodiment of the invention.

The electro-optical device 1 includes a liquid crystal panel AA, a liquid crystal driving circuit 10 that drives the liquid crystal panel AA, a control circuit 20 that controls the liquid crystal driving circuit 10, and a liquid crystal driving power supply circuit 50 that supplies a voltage to the liquid crystal panel AA and the liquid crystal driving circuit 10. The liquid crystal driving circuit 10 has a scanning line driving circuit 30 and a data line driving circuit 40. The control circuit 20 has a display control unit 21 and an image data converting unit 22.

Figure 2:
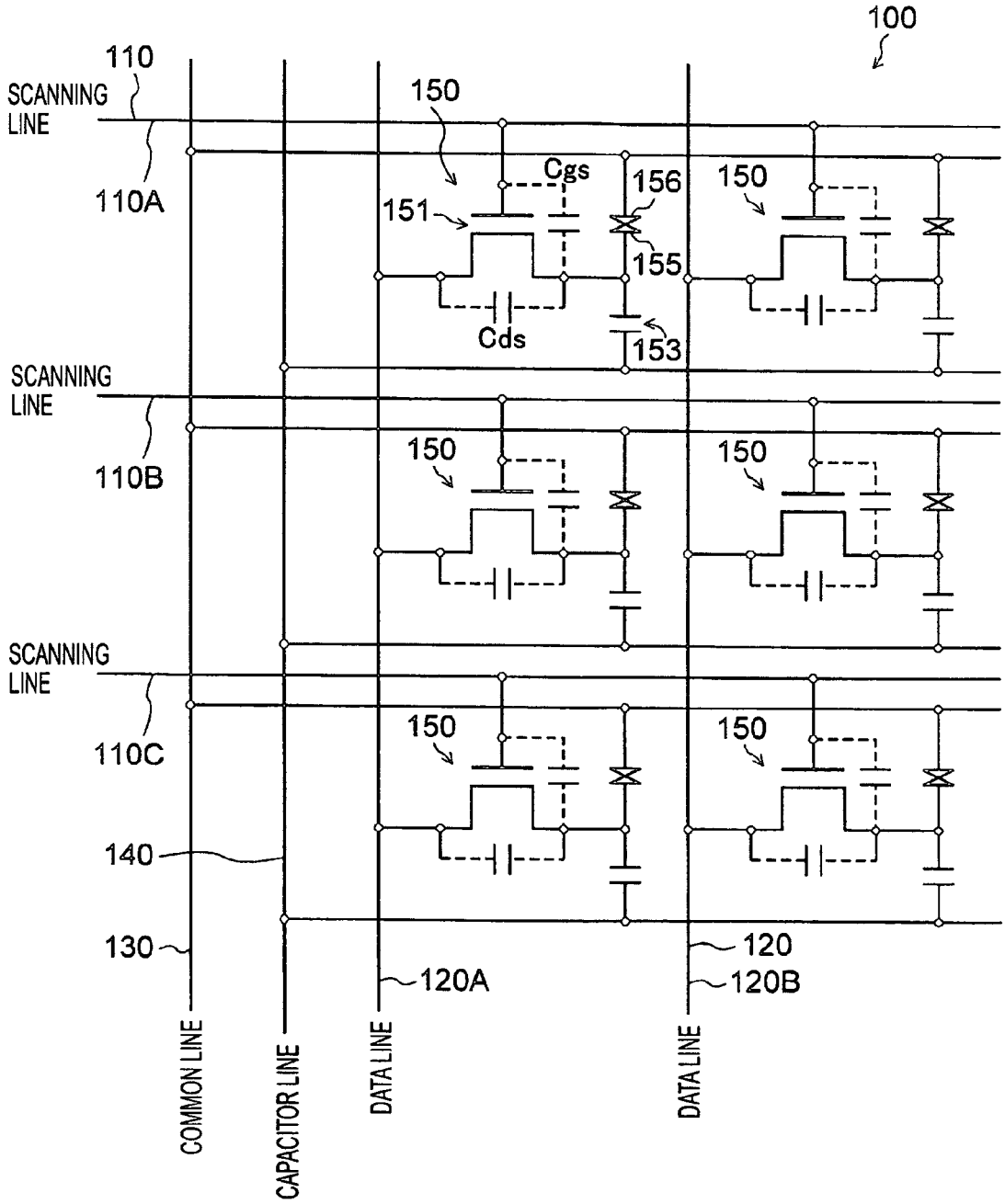
FIG. 2 is a partially enlarged plan view of a liquid crystal panel of the electro-optical device.

FIG. 2 is a partially enlarged plan view of the liquid crystal panel AA.

The liquid crystal panel AA includes an element substrate 100, a counter substrate 200, and liquid crystal (see FIG. 1). In this case, the element substrate 100 serves as a first substrate in which thin film transistors 151 (hereinafter, referred to as TFTs) serving as switching elements, which will be described in detail below, are disposed in a matrix, the counter substrate 200 serves as a second substrate which is disposed opposite to the element substrate 100, and the liquid crystal is an electro-optical material which is interposed between the element substrate 100 and the counter substrate 200.

The above-mentioned liquid crystal driving circuit 10 is formed on the element substrate 100 of the liquid crystal panel AA.

The element substrate 100 includes a plurality of scanning lines 110 that are provided at a predetermined gap, a plurality of data lines 120 that are disposed in a direction substantially orthogonal to the plurality of scanning lines 110 and provided at a predetermined gap, and capacitor lines 140 that are disposed substantially parallel to the plurality of scanning lines 110 and provided alternatively with to the plurality of scanning lines 110. In FIG. 2, for example, the plurality of scanning lines correspond to scanning lines 110A, 110B, and 110C of the scanning lines 110, which are sequentially disposed from the top, and the plurality of data lines corresponds to data lines 120A and 120B of the data lines 120 which are sequentially disposed from the left.

A plurality of pixels 150 are provided at intersections between the plurality of scanning lines 110 and the plurality of data lines 120. Each of the pixels 150 includes, in addition to the above-mentioned TFT 151, a pixel electrode 155, and a storage capacitor 153 that has one end connected to the pixel electrode 155 and the other end connected to the capacitor line 140.

A gate of the TFT 151 is connected to the scanning line 110, a source of the TFT 151 is connected to the data line 120, and a drain of the TFT 151 is connected to the pixel electrode 155 and the storage capacitor 153. When the TFT 151 is applied with a selection voltage from the scanning line 110, it allows the data line 120, the pixel electrode 155, and the storage capacitor 153 to enter an electrically conductive state.

In the counter substrate 200, a plurality of common lines 130 are provided so as to be substantially parallel to the plurality of scanning lines 110. Further, in the counter electrode 200, a common electrode 156 is formed so as to be opposite to the pixel electrode 155, and the common electrode 156 is connected to the common line 130.

The scanning line driving circuit 30 line-sequentially supplies a selection voltage for allowing the TFTs 151 to be turned on to the respective scanning lines 110. For example, if the selection voltage is supplied to any scanning line 110, all of the TFTs 151 connected to the corresponding scanning line 110 are turned on, and all of pixels corresponding to the scanning line 110 are selected.

The data line driving circuit 40 supplies an image signal to each data line 120, and sequentially writes the image data in the pixel electrode 155 of the pixel 150 through the TFT 151 which has been turned on. In a state in which a voltage of the common electrode 156 is used as a reference voltage, the data line driving circuit 40 alternately performs positive polarity writing in which the image signal is supplied to the data line 120 with a voltage greater than a voltage of the common electrode 156, and negative polarity writing in which the image signal is supplied to the data line 120 with a voltage smaller than a voltage of the common electrode 156.

In order to prevent the liquid crystal from being burned, the data line driving circuit 40 is driven in a 1H inversion driving mode in which the positive polarity writing and the negative polarity writing are alternately performed for every one horizontal line by using an alternating voltage.

The display control unit 21 selects either an entire screen display mode or a partial display mode on the basis of an input display switching signal, and outputs a mode selection signal indicating the selected display mode to the scanning line driving circuit 30 and the liquid crystal driving power supply circuit 50.

The image data converting unit 22 converts the input image signal in accordance with the positive polarity writing mode or the negative polarity writing mode, and outputs the converted signal to the data line driving circuit 40.

Figure 3:
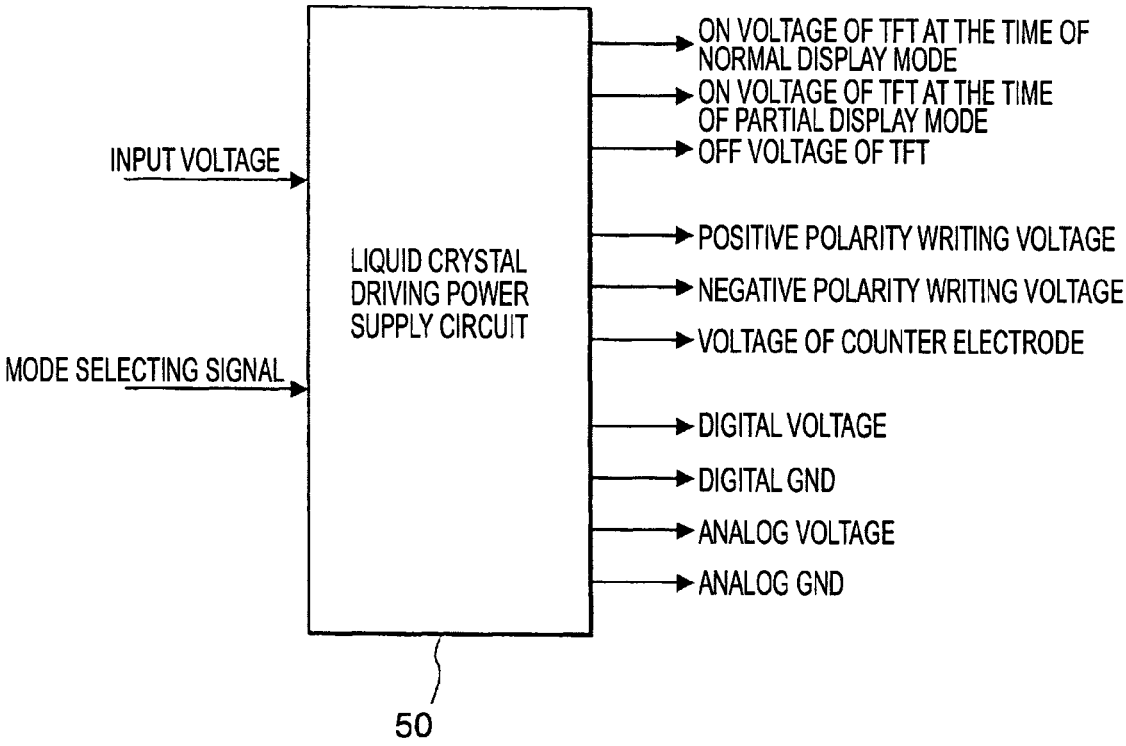
FIG. 3 is a block diagram of a liquid crystal driving power supply circuit of the electro-optical device.

FIG. 3 is a block diagram of the liquid crystal driving power supply circuit 50. The liquid crystal driving power supply circuit 50 supplies a voltage to each of the scanning line driving circuit 30, the data line driving circuit 40, and the liquid crystal panel AA.

Voltages, which the liquid crystal driving power supply circuit 50 supplies to the scanning line driving circuit 30, include an on voltage of a TFT at the time of a normal display mode which is a first voltage for allowing the TFT 151 to be turned on in the normal display mode, an on voltage of a TFT at the time of a partial display mode which is a second voltage for allowing the TFT 151 to be turned on in the partial display mode, an off voltage of a TFT for allowing the TFT 151 to be turned off in both the normal display mode and the partial display mode, an analog voltage and an analog GND that drive an analog portion of the scanning line driving circuit 30, and a digital voltage and a digital GND that drive a digital portion of the scanning line driving circuit 30.

In addition, voltages, which the liquid crystal driving power supply circuit 50 supplies to the data line driving circuit 40, include a positive polarity writing voltage used at the time of positive polarity writing, a negative polarity writing voltage used at the time of negative polarity writing, an analog voltage and an analog GND that drive an analog portion of the data line driving circuit 40, and a digital voltage and a digital GND that drive a digital portion of the data line driving circuit 40.

In addition, voltages, which the liquid crystal driving power supply circuit 50 supplies to the liquid crystal panel AA, includes a common electrode voltage that sets a voltage of the common electrode 156, and a digital voltage and a digital GND that drive the liquid crystal panel AA.

In the entire screen display mode, the electro-optical device 1 having the above-mentioned structure is operated as follows.

The scanning line driving circuit 30 line-sequentially supplies an on voltage of a TFT at the time of a normal display mode being a first voltage supplied from the liquid crystal driving power supply circuit 50 to the scanning line 110 as a selection voltage, so that all of the pixels 150 corresponding to a predetermined scanning line 110 are selected. The data line driving circuit 40 supplies an image signal to the corresponding data line 120 in synchronization with the selection of the pixel 150. Thereby, the image signal is supplied to all of the pixels selected by the scanning line driving circuit 30, so that the image data is written in the pixel electrode 155.

If the image data is written in the pixel electrode 155, a driving voltage is applied to the liquid crystal by the potential difference between the pixel electrode 155 and the common electrode 156. Accordingly, a voltage level of the image signal is changed, so that the alignment or order of the liquid crystal molecules is changed, which results in gray-scale display through optical modulation of each pixel.

In addition, the driving voltage that is applied to the liquid crystal is held by the storage capacitor 153 for a longer time, namely, for a period as much as three orders of magnitude longer than the time for which the image signal is written.

In addition, in the partial display mode, the electro-optical device 1 having the above-mentioned structure is operated as follows.

Figure 4:
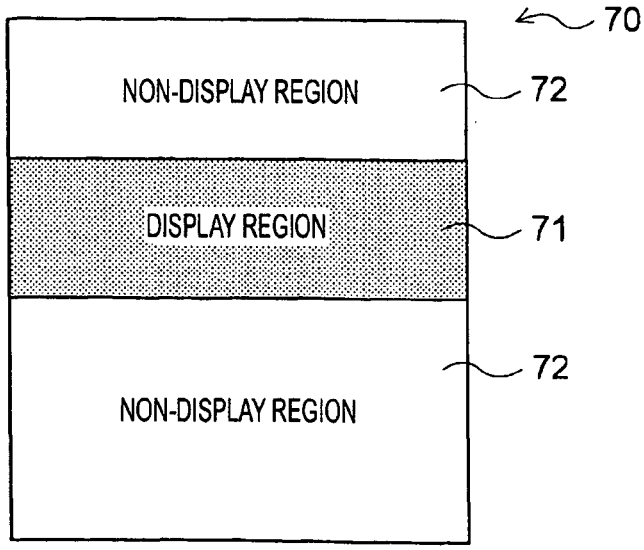
FIG. 4 is a diagram illustrating a display screen of a liquid crystal panel in a partial display mode.

FIG. 4 is a diagram illustrating a display screen of the liquid crystal panel AA in the partial display mode.

In the partial display mode, a display screen 70 is divided into a display region 71, and non-display regions 72 with the display region 71 interposed therebetween. On the display region 71, a remaining battery capacity or time is displayed, and nothing is displayed on the non-display regions 72. That is, in a normally white mode, the non-display region is displayed with a white color, and in a normally black mode, the non-display region is displayed with a black color.

In the above-mentioned partial display mode, the display region becomes narrower than that in the entire screen display mode, but one frame period is not changed. As a result, in the display region 71, a selection period per scanning line 110 becomes longer than a selection period per scanning line 110 in the entire screen display mode.

In addition, since nothing is displayed on the non-display regions 72, with a lower frequency than the display region 71, for example, updating is once performed for five frames.

Hereinafter, the operation of the electro-optical device 1 in the entire screen display mode and the partial display mode will be described with reference to FIGS. 5 and 6.

Figure 5:
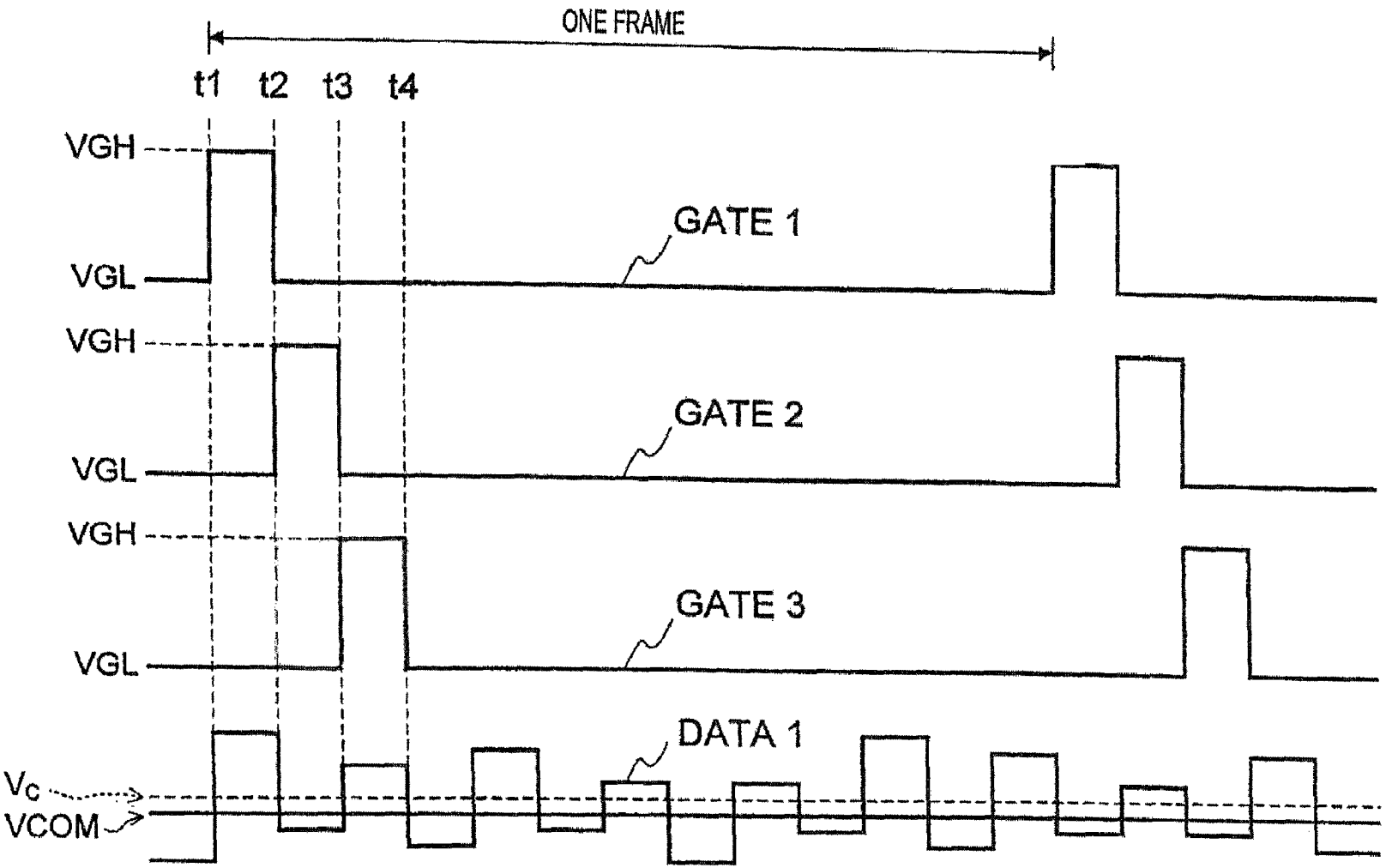
FIG. 5 is a timing chart in an entire screen display mode of the electro-optical device.
Figure 6:
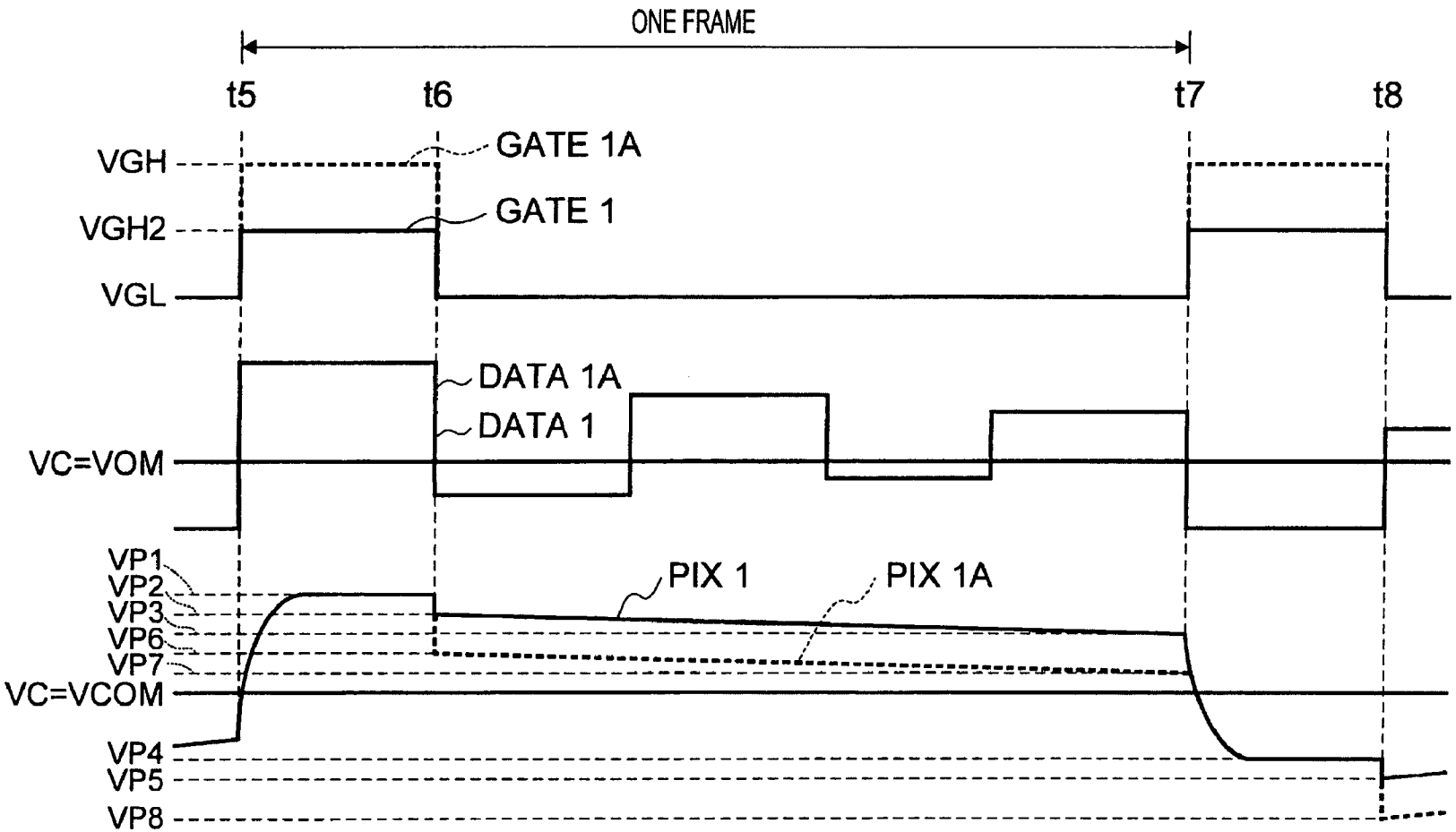
FIG. 6 is a timing chart in a partial display mode of the electro-optical device.

In FIGS. 5 and 6, GATE 1 to GATE 3, DATA 1, and PIX 1 indicate voltages of the scanning lines 110A to 110C, the data line 120A, and the pixel 150 provided at the intersection between the scanning line 110A and the data line 120A in the electro-optical device 1, respectively. In addition, VCOM indicates a voltage of the common electrode 156, and Vc indicates a center voltage between the image signal in the positive polarity writing and the image signal in the negative polarity writing.

In addition, in FIG. 6, GATE 1A, DATA 1A, and PIX 1A indicate voltages of the scanning line, the data line, and the pixel provided at the intersection between the scanning line and the data line in the electro-optical device according to the related art, respectively.

FIG. 5 is a timing chart in the entire screen display mode of the electro-optical device 1.

First, for a period of time from a time t1 to a time t2, the positive polarity writing is performed. That is, a selection voltage is supplied to the scanning line 110A by the scanning line driving circuit 30, a voltage GATE 1 of the scanning line 110A is set to a voltage VGH, and all of the TFTs 151 of one horizontal line corresponding to the scanning line 110A are turned on.

At the same time, with a voltage greater than the voltage VCOM of the common electrode 156, the data line driving circuit 40 supplies the image signal to the data line 120A such that the image data is written in the pixel electrode 155 through the TFT 151.

Next, for a period of time from a time t2 to a time t3, the negative polarity writing is performed. That is, a selection voltage is supplied to the scanning line 110B by the scanning line driving circuit 30, a voltage GATE 2 of the scanning line 110B is set to a voltage VGH, and all of the TFTs 151 of one horizontal line corresponding to the scanning line 110B are turned on.

At the same time, with a voltage smaller than the voltage VCOM of the common electrode 156, the data line driving circuit 40 supplies the image signal to the data line 120A such that the image data is written in the pixel electrode 155 through the TFT 151.

Next, for a period of time from a time t3 to a time t4, the positive polarity writing is performed. That is, a selection voltage is supplied to the scanning line 110C by the scanning line driving circuit 30, a voltage GATE 3 of the scanning line 110C is set to a voltage VGH, and all of the TFTs 151 of one horizontal line corresponding to the scanning line 110C are turned on.

At the same time, with a voltage greater than the voltage VCOM of the common electrode 156, the data line driving circuit 40 supplies the image signal to the data line 120A such that the image data is written in the pixel electrode 155 through the TFT 151.

As described above, the positive polarity writing and the negative polarity writing are alternately and repeatedly performed for every one horizontal scanning period in a 1H inversion driving mode, thereby generating one frame.

FIG. 6 is a timing chart in the partial display mode of the electro-optical device 1. In FIG. 6, for convenience of recognition, in both the positive polarity writing and the negative polarity writing, the writing is performed with the same gray-scale level. In this case, the selection period of one horizontal line in the partial display mode is three times as much as the selection period of one horizontal line in the entire screen display mode. Specifically, the period of time from a time t5 to a time t6 becomes equal to the period of time from a time t1 to a time t4.

First, for a period of time from a time t5 to a time t6, the positive polarity writing is performed. That is, a selection voltage is supplied to the scanning line 110A by the scanning line driving circuit 30, a voltage GATE 1 of the scanning line 110A is set to a voltage VGH 2, and all of the TFTs 151 of one horizontal line corresponding to the scanning line 110A are turned on. In this case, a voltage VGH 2 is half a voltage VGH.

At the same time, with a voltage VP1 higher than the voltage VCOM of the common electrode 156, the data line driving circuit 40 supplies the image signal to the data line 120A such that the image data is written in the pixel electrode 155 through the TFT 151.

In the partial display mode, the scanning line driving circuit 30 line-sequentially supplies an on voltage of a TFT at the time of a partial display mode being a second voltage supplied from the liquid crystal driving power supply circuit 50 to the scanning line 110 as the selection voltage. As a result, the voltage GATE 1 of the scanning line 110A becomes smaller than the voltage GATE 1A of the scanning line in the electro-optical device according to the related art.

Next, at the time t6, all of the TFTs 151 of one horizontal line corresponding to the scanning line 110A are turned off by the scanning line driving circuit 30. In this case, an electric charge accumulated in the storage capacitor 153 and an electric charge accumulated in a pixel capacitor consisting of the pixel electrode 155 and the common electrode 156 are redistributed while including parasitic capacitances Cgs and Cds, thereby generating pushdown. As a result, the voltage PIX 1 of the pixel electrode 155 is reduced to become VP2, and the potential difference between the voltage VP2 of the pixel electrode 155 and the voltage VCOM of the common electrode 156 is applied to the liquid crystal.

In the meantime, for a period of time from a time t5 to a time t6, the voltage GATE 1 of the scanning line 110A is smaller than the voltage GATE 1A of the scanning line in the electro-optical device according to the related art. For this reason, a pushdown voltage is (VP1-VP6) in the voltage PIX 1A of the pixel in the electro-optical device according to the related art, but a pushdown voltage is (VP1-VP2) in the voltage PIX 1 of the pixel 150 in the electro-optical device 1 according to the present embodiment. That is, in the electro-optical device 1 according to the present embodiment, a pushdown voltage is reduced, as compared with the electro-optical device according to the related art.

Next, for a period of time from a time t6 to a time t7, an electric charge accumulated in the pixel capacitor and the storage capacitor 153 is gradually discharged, and the voltage PIX 1 of the pixel electrode 155 is reduced from VP2 to VP3. In addition, in the electro-optical device according to the related art, the voltage PIX 1A of the pixel electrode is reduced from VP6 to VP7.

Next, for a period of time from a time t7 to a time t8, the negative polarity writing is performed. That is, a selection voltage is supplied to the scanning line 110A by the scanning line driving circuit 30, a voltage GATE1 of the scanning line 110A is set to a voltage VGH2, and all of the TFTs 151 of one horizontal line corresponding to the scanning line 110A are turned on.

At the same time, with a voltage VP4 smaller than the voltage VCOM of the common electrode 156, the data line driving circuit 40 supplies the image signal to the data line 120A such that the image data is written in the pixel electrode 155 through the TFT 151.

In the partial display mode, the scanning line driving circuit 30 line-sequentially supplies an on voltage of a TFT at the time of a partial display mode being a second voltage supplied from the liquid crystal driving power supply circuit 50 to the scanning line 110 as the selection voltage. As a result, the voltage GATE1 of the scanning line 110A becomes smaller than the voltage GATE1A of the scanning line in the electro-optical device according to the related art.

Next, at the time t8, all of the TFTs 151 of one horizontal line corresponding to the scanning line 110A are turned off by the scanning line driving circuit 30. In this case, an electric charge accumulated in the storage capacitor 153 and an electric charge accumulated in a pixel capacitor consisting of the pixel electrode 155 and the common electrode 156 are redistributed while including parasitic capacitances Cgs and Cds, thereby generating pushdown. As a result, the voltage PIX1 of the pixel electrode 155 is reduced to become VP5, and the potential difference between the voltage VP5 of the pixel electrode 155 and the voltage VCOM of the common electrode 156 is applied to the liquid crystal.

In the meantime, for a period of time from a time t7 to a time t8, the voltage GATE1 of the scanning line 110A is smaller than the voltage GATE1A of the scanning line in the electro-optical device according to the related art. Accordingly, a pushdown voltage is (VP4-VP8) in the voltage PIX1A of the pixel in the electro-optical device according to the related art, but a pushdown voltage is (VP4-VP5) in the voltage PIX1 of the pixel 150 in the electro-optical device 1 according to the present embodiment. That is, in the electro-optical device 1 according to the present embodiment, a pushdown voltage is reduced, as compared with the electro-optical device according to the related art.

According to the present embodiment, the following effects are obtained.

(1) Since the selection period of one horizontal line in the partial display mode is three times as much as the selection period of one horizontal line in the entire screen display mode, in the partial display mode, it is possible to relatively reduce the influence due to the variation of the period, for which the TFT 151 is turned on, with respect to a period required for sufficiently writing the image data in the pixel electrode 155. Therefore, it is possible to ensure time needed for the image data to write in the pixel electrode 155, a color variation of the displayed image can be reduced, and an image quality can be prevented from being deteriorated.

(2) In the partial display mode, since the selection voltage is supplied to the scanning line 110 with a voltage smaller than that in the entire screen display mode, it is possible to reduce the pushdown voltage. Accordingly, it is possible to reduce the burning and flickering of the display region in the partial display mode.

(3) In the partial display mode, since the selection voltage is supplied to the scanning line 110 with a voltage smaller than that in the entire screen display mode, a consumed power can be reduced.

In addition, since the selection period per scanning line 110 in the partial display mode becomes longer than that in the entire screen display mode, an operation clock when the selection voltage is supplied to the scanning line 110 from the scanning line driving circuit 30 may be reduced. Accordingly, it is possible to further reduce the consumed power in the partial display region.

Second Embodiment

Figure 7:
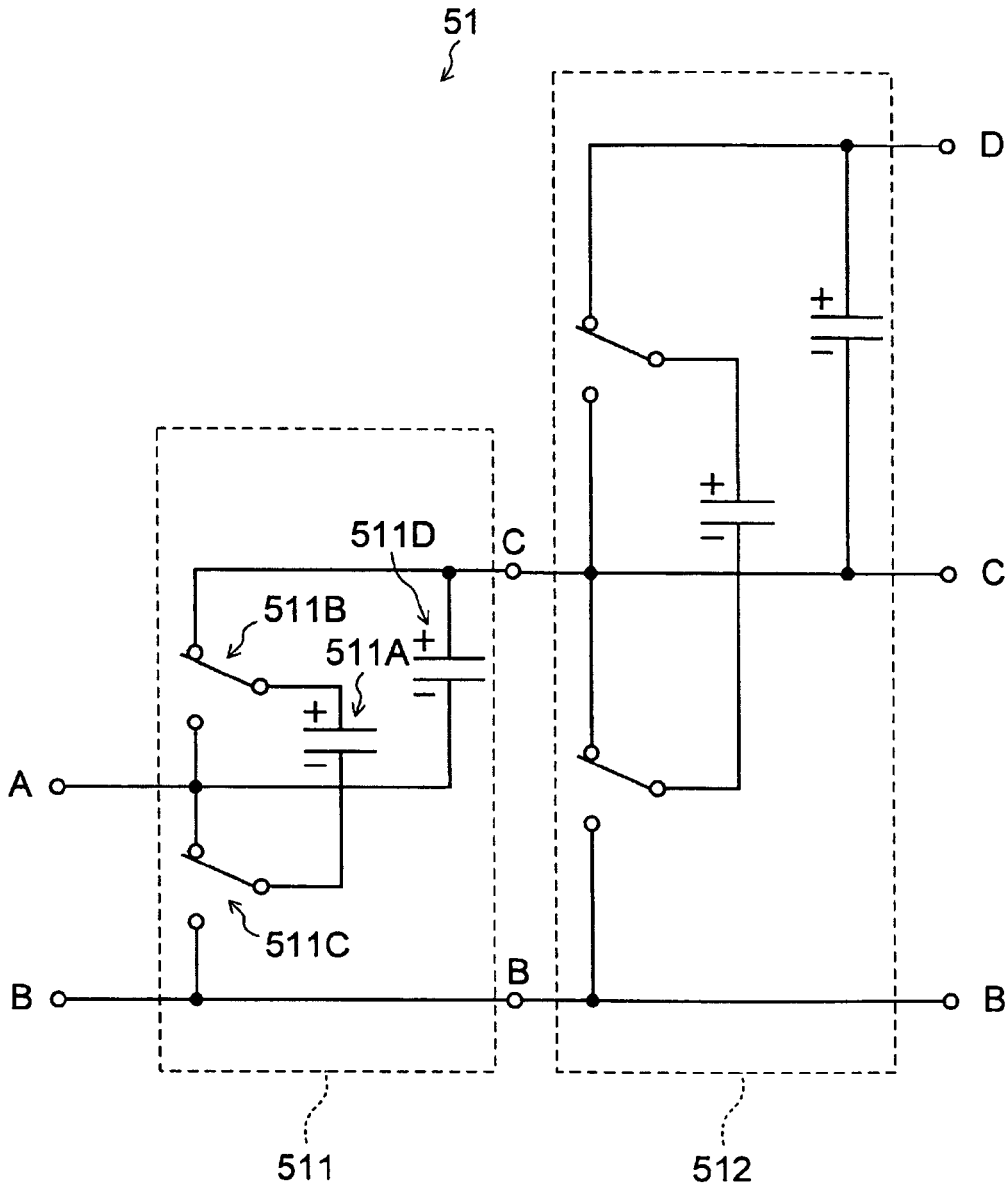
FIG. 7 is a circuit diagram of a charge pump circuit included in a liquid crystal driving power supply circuit according to a second embodiment of the invention.

FIG. 7 is a circuit diagram illustrating a charge pump circuit 51 according to a second embodiment of the invention. The charge pump circuit 51 is provided in the liquid crystal driving power supply circuit 50, and includes a first charge pump unit circuit 511, and a second charge pump unit circuit 512.

The first charge pump unit circuit 511 includes input terminals A and B, and an output terminal C. The first charge pump unit circuit 511 applies the potential difference between the input terminals A and B to a voltage of the input terminal A so as to be output from the output terminal C. That is, the first charge pump unit circuit 511 raises a voltage of the input terminal A to about two times as much as the corresponding voltage so as to be output from the output terminal C.

Specifically, the first charge pump unit circuit 511 includes a capacitor 511A, a switching element 511B that connects one end of the capacitor 511A to the input terminal A or the output terminal C, a switching element 511C that connects the other end of the capacitor 511A to the input terminal A or the input terminal B, and a capacitor 511D that has one end connected to the input terminal A and the other end connected to the output terminal C.

The switching elements 511B and 511C perform the switching operation in cooperation with each other. That is, when the switching element 511B connects one end of the capacitor 511A to the input terminal A, the switching element 511C connects the other end of the capacitor 511A to the input terminal B. In contrast, when the switching element 511B connects one end of the capacitor 511A to the output terminal C, the switching element 511C connects the other end of the capacitor 511A to the input terminal A.

First, the switching element 511B connects one end of the capacitor 511A to the input terminal A, and the switching element 511C connects the other end of the capacitor 511A to the input terminal B. In this state, a digital input voltage VDD is supplied to the input terminal A, and the digital GND is supplied to the input terminal B.

In this case, the digital voltage VDD is charged in the capacitor 511A.

Next, each of the switching elements 511B and 511C is switched. That is, the switching element 511B connects one end of the capacitor 511A to the output terminal C, and the switching element 511C connects the other end of the capacitor 511A to the input terminal A. In this case, a digital voltage 2VDD, which is a sum of the digital voltage VDD charged in the capacitor 511A and the digital input voltage VDD supplied from the input terminal A, is charged in the capacitor 511D.

As described above, the first charge pump unit circuit 511 raises the digital input voltage VDD to the digital voltage 2VDD which is two times as much as the digital input voltage VDD. The digital voltage 2VDD is output from the output terminal C, and then supplied to the second charge pump unit circuit 512.

The second charge pump unit circuit 512 has the same structure as the first charge pump unit circuit 511. That is, the second charge pump unit circuit 512 includes input terminals B and C, and an output terminal D. The second charge pump unit circuit 512 applies the potential difference between the input terminals B and C to a voltage of the input terminal C so as to be output from the output terminal D.

Since the input terminal C is supplied with the digital voltage 2VDD, the second charge pump unit circuit 512 raises the digital voltage 2VDD supplied from the first charge pump unit circuit 511 to a voltage, which is two times as much as the digital voltage 2VDD, that is, a digital voltage 4VDD, which is four times as much as the digital input voltage VDD, so as to be output from the output terminal D.

In addition, a digital input voltage of 4 V and a digital GND of 0 V, which are respectively output from the input terminals A and B, are supplied to the above-mentioned charge pump circuit 51. In this case, the charge pump circuit 51 outputs a digital voltage of 8 V and a digital voltage of 16 V through the output terminals C and D, respectively.

In addition, in the electro-optical device having the above-mentioned charge pump circuit 51, a first voltage is 16 V for allowing the TFT 151 to be turned on in the normal display mode, and a second voltage is 8 V for allowing the TFT 151 to be turned on in the partial display mode.

According to the present embodiment, in addition to the above-mentioned (1) to (3), the following effects can be obtained.

(4) The charge pump circuit 51 outputs a first voltage for allowing the TFT 151 to be turned on in the normal display mode, and a second voltage for allowing the TFT 151 to be turned on in the partial display mode. Therefore, if the liquid crystal driving power supply circuit having the charge pump circuit 51 is one, the scanning line driving circuit 30 can supply the selection voltage of the first and second voltages to the scanning line 110. Accordingly, it is possible to reduce a circuit size or a consumed power, as compared with a case which requires two liquid crystal driving power supply circuits, including a liquid crystal driving power supply circuit that generates the first voltage, and a liquid crystal driving power supply circuit that generates the second voltage.

(5) After the two stages of charge pump unit circuits 511 and 512, each of which serves as a voltage raising circuit, are connected in series to each other, they are provided in the charge pump circuit 51. In the entire screen display mode, a voltage, which the charge pump unit circuit 512 as a final stage of a voltage raising circuit generates, is set to the selection voltage of the first voltage and in the partial display mode, a voltage, which the channel pump unit circuit 511 as a middle stage of a voltage raising circuit generates, is set to the selection voltage of the second voltage, and the selection voltage of the first voltage and the selection voltage of the second voltage are supplied to the scanning line 110. Therefore, in the partial display mode, the rear stage of voltage raising circuit, that is, the charge pump unit circuit 512 does not need to be driven by the charge pump unit circuit 511 of the charge pump unit circuits 511 and 512 (voltage raising circuits) which is a middle stage of a voltage raising circuit that generates a second voltage. Accordingly, in the partial display mode, it is possible to further reduce a consumed power.

Third Embodiment

Figure 8:
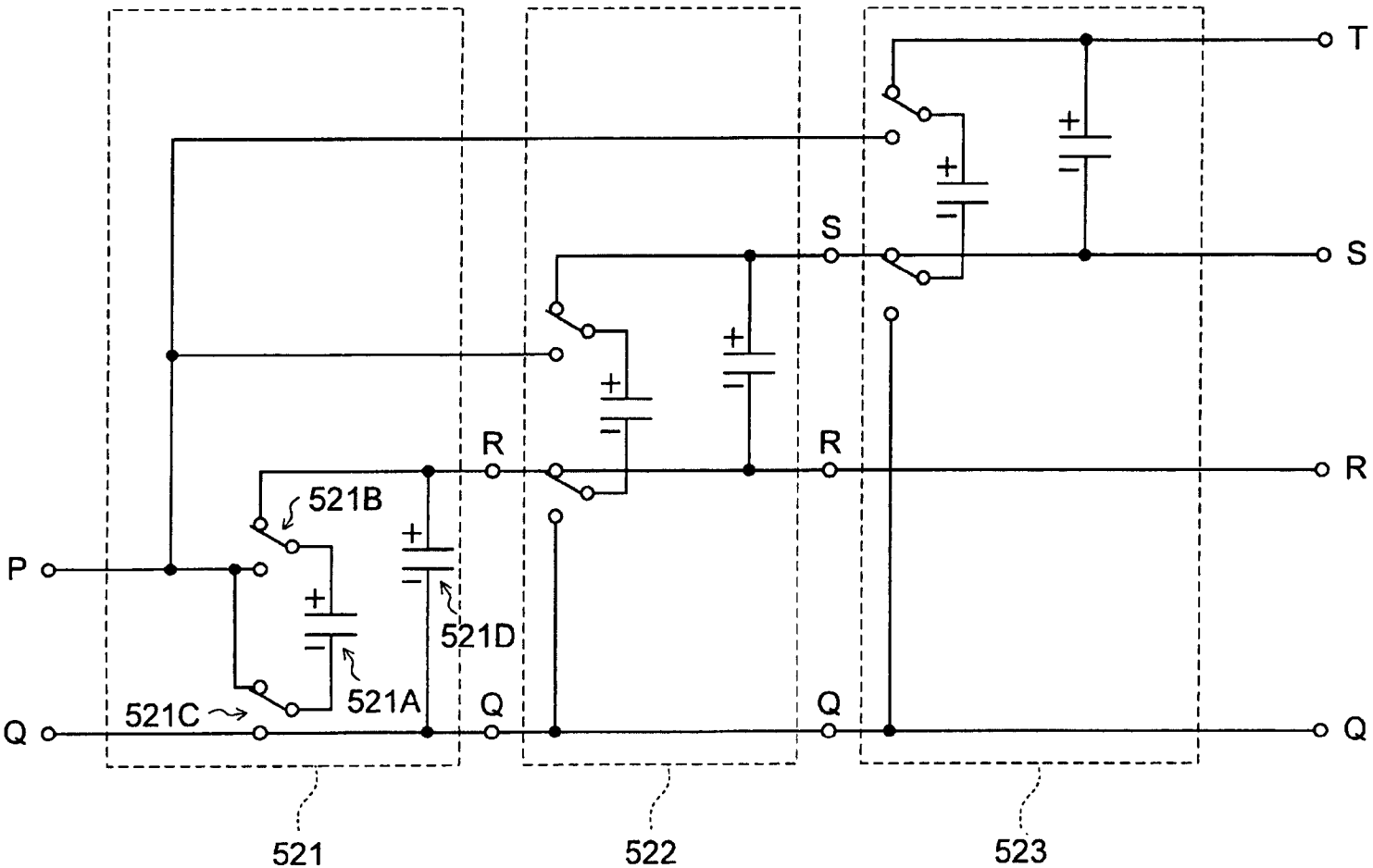
FIG. 8 is a circuit diagram of a charge pump circuit included in a liquid crystal driving power supply circuit according to a third embodiment of the invention.

FIG. 8 is a circuit diagram of the charge pump circuit 52 according to a third embodiment of the invention. The charge pump circuit 52 of FIG. 8 is different from the charge pump circuit 51 of FIG. 7 in a value of a digital voltage that raises a digital input voltage to output it. The charge pump circuit 52 is provided in the liquid crystal driving power supply circuit, and includes a third charge pump unit circuit 521, a fourth charge pump unit circuit 522, and a fifth charge pump unit circuit 523.

The third charge pump unit circuit 521 includes input terminals P and Q, and an output terminal R. The third charge pump unit circuit 521 applies the potential difference between the input terminals P and Q to a voltage of the input terminal P so as to be output from the output terminal R. That is, the third charge pump unit circuit 521 raises a voltage of the input terminal to a voltage, which is two times as much as the corresponding voltage, so as to be output from the output terminal R.

Specifically, the third charge pump unit circuit 521 includes a capacitor 521A, a switching element 521B that connects one end of the capacitor 521A to the input terminal P or the output terminal R, a switching element 521C that connects the other end of the capacitor 521A to the input terminal P or the input terminal Q, and a capacitor 521D that has one end connected to the input terminal R and the other end connected to the output terminal Q.

The switching elements 521B and 521C perform the switching operation in cooperation with each other. That is, when the switching element 521B connects one end of the capacitor 521A to the input terminal P, the switching element 521C connects the other end of the capacitor 521A to the input terminal Q. In contrast, when the switching element 521B connects one end of the capacitor 521A to the output terminal R, the switching element 521C connects the other end of the capacitor 521A to the input terminal P.

First, the switching element 521B connects one end of the capacitor 521A to the input terminal P, and the switching element 521C connects the other end of the capacitor 521A to the input terminal Q. In this state, a digital input voltage VDD is supplied to the input terminal P, and the digital GND is supplied to the input terminal Q.

In this case, the digital voltage VDD is charged in the capacitor 521A.

Next, each of the switching elements 521B and 521C is switched. That is, the switching element 521B connects one end of the capacitor 521A to the output terminal R, and the switching element 521C connects the other end of the capacitor 521A to the input terminal P. In this case, a digital voltage 2VDD, which is a sum of the digital voltage VDD charged in the capacitor 521A and the digital input voltage VDD supplied from the input terminal P, is charged in the capacitor 521D.

As described above, the third charge pump unit circuit 521 raises the digital input voltage VDD to the digital voltage 2VDD which is two times as much as the digital input voltage VDD. The digital voltage 2VDD is output from the output terminal R, and then supplied to the fourth charge pump unit circuit 522.

The fourth charge pump unit circuit 522 has the same structure as the third charge pump unit circuit 521. That is, the fourth charge pump unit circuit 522 includes input terminals Q and R, and an output terminal S. The fourth charge pump unit circuit 522 applies the potential difference between the input terminals Q and R to a voltage of the input terminal R so as to be output from the output terminal S.

Since the input terminal R is supplied with the digital voltage 2VDD, the fourth charge pump unit circuit 522 raises a voltage to a sum between the digital voltage 2VDD supplied from the third charge pump unit circuit 521 and the digital input voltage VDD supplied from the input terminal R, that is, a digital voltage 3VDD, which is three times as much as the digital input voltage VDD, so as to be output from the output terminal S.

In addition, the fifth charge pump unit circuit 523 has the same structure as the third charge pump unit circuit 521 and the fourth charge pump unit circuit 522. That is, the fifth charge pump unit circuit 523 includes input terminals Q and S, and an output terminal T. The fifth charge pump unit circuit 523 applies the potential difference between the input terminals Q and S to a voltage of the input terminal S so as to be output from the output terminal T.

Since the input terminal S is supplied with the digital voltage 3VDD, the fifth charge pump unit circuit 523 raises a voltage to a sum between the digital voltage 3VDD supplied from the fourth charge pump unit circuit 522 and the digital input voltage VDD supplied from the input terminal P, that is, a digital voltage 4VDD, which is four times as much as the digital input voltage VDD, so as to be output from the output terminal T.

In addition, a digital input voltage of 4V and a digital GND of 0 V, which are respectively output from the input terminals P and Q, are supplied to the above-mentioned charge pump circuit 52. In this case, the charge pump circuit 52 outputs digital voltages of 8 V, 12 V and 16 V through the output terminals R, S, and T, respectively.

In addition, in the electro-optical device having the above-mentioned charge pump circuit 52, a first voltage is 16 V for allowing the TFT 151 to be turned on in the normal display mode, and a second voltage is 8 V for allowing the TFT 151 to be turned on in the partial display mode.

According to the present embodiment, the same effects as the above-mentioned (1) to (5) can be obtained.

Modification

Further, the invention is not limited to the above-mentioned embodiments, but various changes and modifications can be made without departing from the spirit and scope of the invention.

For example, in the above-mentioned embodiments, the charge pump circuits 51 and 52 can raise the digital input voltage to the digital voltage that is four times as much as the corresponding digital input voltage so as to be output, but the invention is not limited thereto, and may raise the digital input voltage to the digital voltage that is eight times as much as the corresponding digital input voltage so as to be output.

Further, in the above-mentioned embodiments, the second voltage is half of the first voltage, but the invention is not limited thereto, and may be a third or a quarter of the first voltage.

In addition, in the above-mentioned embodiments, the invention is applied to the electro-optical device 1 using the liquid crystal, but the invention is not limited thereto, and may be applied to an electro-optical device using an electro-optical material other than the liquid crystal. The electro-optical material refers to a material in which an electro-optical characteristic, such as transmittance or luminance, varies by the supply of an electric signal (current signal or voltage signal). For example, similar to the above-mentioned embodiments, the invention is applied to various electro-optical devices, such as a display panel using an OLED element, made of organic EL (electro luminescent), a light-emitting polymer, or the like, as an electro-optical material, an electrophoresis display panel in which microcapsule containing a colored liquid or a white particle dispersed in the liquid is used as an electro-optical material, a twisting ball display panel in which a twisting ball toned in a different color for each region having a different polarity is used as an electro-optical material, a toner display panel in which a black toner is used as an electro-optical material, or a plasma display panel in which high-pressure gas, such as helium or neon, is used as an electro-optical material.

Application

Next, an electronic apparatus to which the electro-optical device 1 according to the above-mentioned embodiments is applied will be described.

Figure 9:
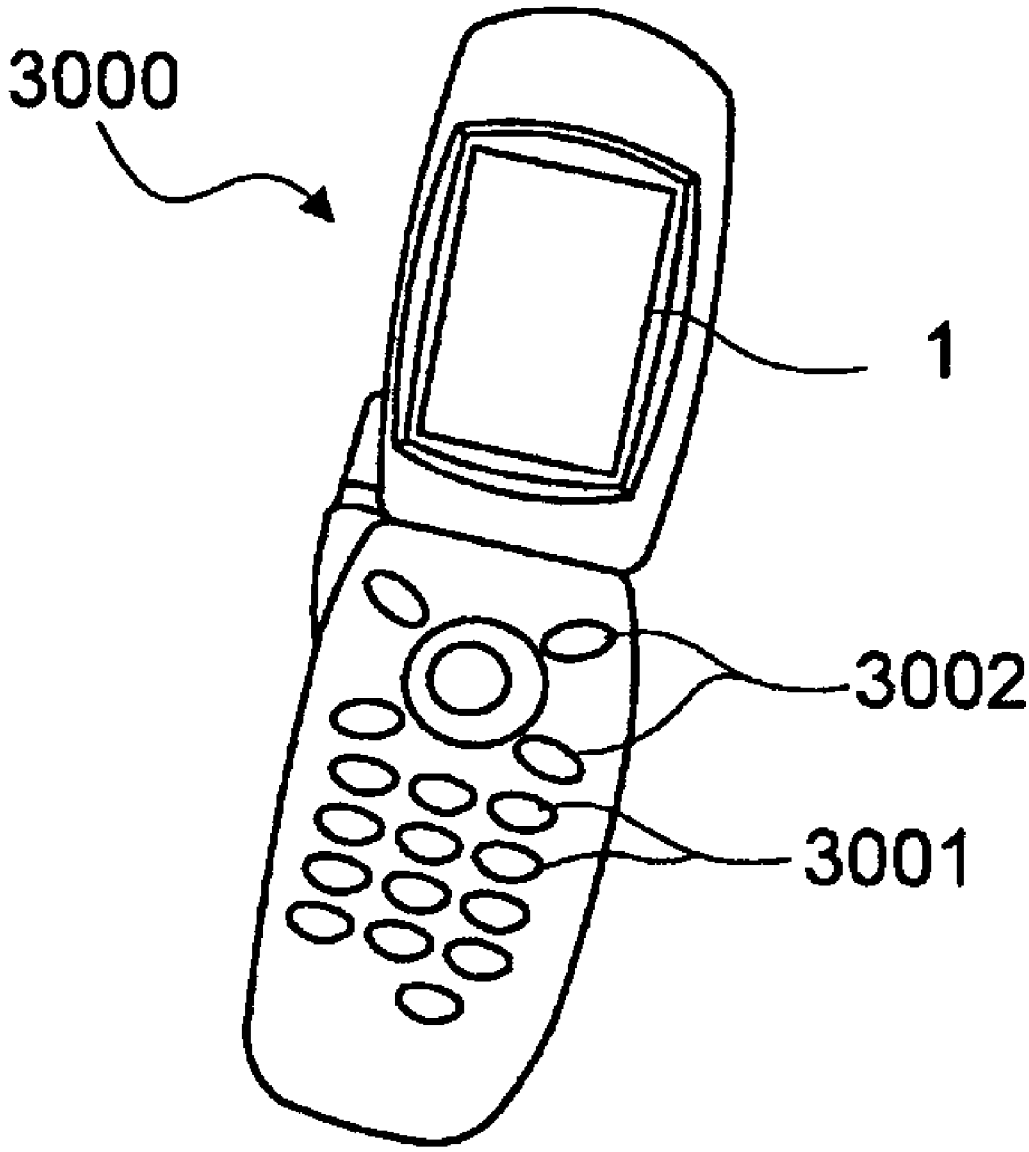
FIG. 9 is a perspective view illustrating a structure of a cellular phone to which the above-mentioned electro-optical device is applied.

FIG. 9 is a perspective view illustrating a structure of a cellular phone to which the above-mentioned electro-optical device 1 is applied. A cellular phone 3000 includes a plurality of operation buttons 3001, a scroll button 3002, and an electro-optical device 1. The scroll button 3002 is operated, and a screen displayed on the electro-optical device 1 is scrolled.

In addition to the cellular phone shown in FIG. 9 as the electronic apparatus to which the electro-optical device 1 is applied, examples of the electronic apparatus may include a personal computer, a portable information terminal, a digital still camera, a liquid crystal television, a view-finder-type or monitor-direct-view video tape recorder, a car navigation device, a pager, an electronic note, an electronic calculator, a word processor, a work station, a video phone, a POS terminal, an apparatus having a touch panel, or the like. In addition, as display units of theses various electronic apparatuses, the above-mentioned electro-optical device can be used.

What is claimed is:

1. An electro-optical device, comprising:

a plurality of scanning lines;

a plurality of data lines;

a plurality of pixels corresponding to intersections between the scanning lines and the data lines, wherein each of the pixels has a pixel electrode, and a switching element which, when turned on by a first or a second selection voltage applied to the corresponding scanning line, electrically connects the corresponding data line to the pixel electrode;

a scanning line driving circuit for supplying the first or the second selection voltage to the scanning lines for selecting the scanning lines in a predetermined order, wherein the first selection voltage and the second selection voltage are sufficient to turn on the switching elements, and wherein the second selection voltage is smaller than the first selection voltage; and a data line driving circuit for supplying image signals to the data lines in accordance with gray-scale levels to be displayed by the pixels corresponding to the selected scanning lines;

wherein said device has an entire screen display mode, in which an entire screen of the device is set for displaying images, and a partial display mode, in which a part of the screen is set as a display region for displaying images and a remaining part of the screen is set as a non-display region not for displaying images; and in the entire screen display mode, the scanning line driving circuit is configured for supplying the first selection voltage to the scanning lines of the display region for a first period to turn on the respective switching elements of the display region during said first period, and an OFF voltage to the scanning lines of the display region to turn off the respective switching elements outside said first period; and in the partial display mode, the scanning line driving circuit is configured for supplying the second selection voltage to the scanning lines of the display region for a second period longer than the first period to turn on the respective switching elements of the display region during said second period, and the OFF voltage to the scanning lines of the display region to turn off the respective switching elements outside said second period.

2. The electro-optical device according to claim 1, wherein in the partial display mode, the scanning line driving circuit supplies the OFF voltage to the scanning lines of the non-display region.

3. The electro-optical device according to claim 1, further comprising:

a power supply circuit for generating the first selection voltage and the second selection voltage, wherein the power supply circuit has a charge pump circuit for raising an input voltage to the first selection voltage and the second selection voltage.

4. The electro-optical device according to claim 3, wherein the charge pump circuit has a plurality of stages of voltage raising circuits that are connected in series to each other, the first selection voltage is generated by a final stage among the stages of voltage raising circuits, and the second selection voltage is generated by a middle stage among the stages of voltage raising circuits.

5. An electronic apparatus, comprising the electro-optical device according to claim 1.

6. A method of driving an electro-optical device, the electro-optical device including a plurality of scanning lines, a plurality of data lines, a plurality of pixels corresponding to intersections between the scanning lines and the data lines, each of the pixels having a pixel electrode, and a switching element which, when turned on by a first or a second selection voltage applied to the corresponding scanning line, electrically connects the corresponding data line to the pixel electrode an entire screen display mode in which an entire screen of the device is set for displaying images, and a partial display mode in which a part of the screen is set as a display region for displaying images and a remaining part of the screen is set as a non-display region not for displaying images, the method comprising:

supplying the first or the second selection voltage to the scanning lines for selecting the scanning lines in a predetermined order, wherein the first selection voltage and the second selection voltage are sufficient to turn on the switching elements, and wherein the second selection voltage is smaller than the first selection voltage; and supplying image signals to the data lines in accordance with gray-scale levels to be displayed by the pixels corresponding to the selected scanning lines;

wherein in the entire screen display mode, the first selection voltage is supplied to the scanning lines of the display region for a first period to turn on the respective switching elements of the display region during said first period, and an OFF voltage is supplied to the scanning lines of the display region to turn off the respective switching elements outside said first period; and in the partial display mode, the second selection voltage is supplied to the scanning lines of the display region for a second period longer than the first period to turn on the respective switching elements of the display region during said second period, and the OFF voltage is supplied to the scanning lines of the display region to turn off the respective switching elements outside said second period.

7. The method according to claim 6, wherein in the partial display mode, the OFF voltage is supplied to the scanning lines of the non-display region.

8. The method according to claim 6, wherein the OFF voltage is lower than both the first and the second selection voltages.

9. The electro-optical device according to claim 1, wherein the OFF voltage is lower than both the first and the second selection voltages.

* * * * *